United States Patent [19]

Blanc

[11] Patent Number: 4,571,855

[45] Date of Patent: Feb. 25, 1986

[54] INTEGRATED CLOSURE SYSTEM FOR A SKI BOOT

[75] Inventor: Roger Blanc, Izeaux, France

[73] Assignee: Salomon S.A., Annecy, France

[21] Appl. No.: 553,888

[22] Filed: Nov. 21, 1983

[30] Foreign Application Priority Data

Nov. 24, 1982 [FR] France ..... 82 19676

[51] Int. Cl.[4] ..... A43C 11/00; A43B 5/04

[52] U.S. Cl. ..... 36/50; 36/117; 36/120; 24/68 SK; 24/71 SK

[58] Field of Search ..... 36/117–121, 36/50, 105; 24/68 SK, 69 SK, 70 SK, 71 SK

[56] References Cited

U.S. PATENT DOCUMENTS

| | | | |
|---|---|---|---|
| 4,083,129 | 4/1978 | Collombin et al. . | |
| 4,281,468 | 8/1981 | Giese et al. | 36/121 |
| 4,360,979 | 11/1982 | Spademan | 36/121 |
| 4,408,403 | 10/1983 | Martin | 36/117 X |

FOREIGN PATENT DOCUMENTS

| | | | |
|---|---|---|---|
| 1097063 | 3/1981 | Canada | 36/50 |
| 0015862 | 9/1980 | European Pat. Off. | 36/117 |
| 0053340 | 6/1982 | European Pat. Off. . | |
| 1963342 | 6/1971 | Fed. Rep. of Germany . | |
| 2752241 | 6/1978 | Fed. Rep. of Germany . | |
| 2800187 | 7/1978 | Fed. Rep. of Germany . | |
| 6933746 | 4/1980 | Fed. Rep. of Germany . | |
| 3201702 | 9/1982 | Fed. Rep. of Germany . | |
| 2175684 | 10/1973 | France . | |
| 2371896 | 6/1978 | France . | |
| 2450575 | 10/1980 | France . | |
| WO82/02479 | 8/1982 | PCT Int'l Appl. . | |

*Primary Examiner*—James Kee Chi

*Attorney, Agent, or Firm*—Sandler & Greenblum

[57] ABSTRACT

Integrated closure system for a ski or other boot preferably intended for use with a boot having two portions adapted to be drawn together by the closure system. The closure system includes at least one traction cable adapted to be connected at one of its ends to a location provided on at least one of the two portions. The system further includes a traction assembly comprising a cable stretcher and a return element adapted to be mounted on one portion of the boot. The cable stretcher is activated by a control element which can assume at least two positions, namely, an open position in which it frees a length of the traction cable to allow for the opening of the boot, and a closed position in which the traction cable is subjected to a tractional force to draw the two portions towards one another. The return element is adapted to transfer the tractional force exerted on the traction cable by the cable stretcher along an appropriately selected direction to assure good closure of the boot.

27 Claims, 4 Drawing Figures

INTEGRATED CLOSURE SYSTEM FOR A SKI BOOT

BACKGROUND OF THE INVENTION

1. Field of the Invention

The present invention relates to an integrated closure system for use with ski and other sport boots.

2. Description of Prior Art

Numerous possible solutions have been investigated for increasing the efficiency of ski boot closure systems, as well as increasing the rapidity and ease with which ski boots may be opened and closed.

Various solutions considered involve modifying either the general design of the ski boot structure, or simply the design of the closure apparatus, or both, using a specific closure apparatus having a predetermined structure.

As to solutions which propose modifying the structure of the boot, a number of such structures exist, namely:

(a) "wallet" type structures in which the opening of the boot occurs in front of the shell, with a subsequent covering of the shell;

(b) structures of the "front cover or spoiler" type which utilize a wide front opening of the shell covered by a cover or spoiler; and (c) "rear spoiler" type structures in which the boot is formed of two portions, i.e., a front portion, generally made of molded plastic material which comprises a sole, a vamp, the heel seat of the shell, and the front portion of the upper (cuff, front half-shell), and a rear portion or "rear spoiler" which is journalled onto the heel seat of the shell, substantially at the level of the ankle.

In this latter type of structure, the boot is opened by pivoting of the spoiler, which allows for an easy introduction of the foot.

In solutions involving modification of the closure apparatus of the boot, the only significant innovation within the past 15 years has involved the use of hooks which, coupled to rings, have replaced the traditional laces.

It is nevertheless the case that the existing closure apparatus, i.e., hooks, cables, notched or pinioned straps, all suffer the same disadvantages, i.e.:

(a) in each case it is necessary to systematically couple two portions, which necessitates the use of two ungloved hands which exposes the hands to the cold and thus causes discomfort;

(b) it is necessary to squat in order to manipulate the mechanism;

(c) one must, each time, locate and inspect the adjustments; and (d) one must, in all cases, perform between two and five identical operations (this number corresponding, for example, to the number of latch hooking mechanisms).

SUMMARY OF THE INVENTION

It is thus an object of the invention to provide an integrated closure system which overcomes the above disadvantages of prior art techniques.

The integrated closure system for a ski or other boot according to the invention is preferably intended for use with a boot having two portions adapted to be drawn together by the closure system. The closure system includes at least one traction cable adapted to be connected at one of its ends to a location provided on at least one of the two portions. The system further includes a traction assembly comprising a cable stretcher and a return element adapted to be mounted on one portion of the boot.

The cable stretcher is activated by a control element which can assume at least two positions, namely, an open position in which it frees a length of the traction cable to allow for the opening of the boot, and a closed position in which the traction cable is subjected to a tractional force to draw the two portions towards one another. The return element is adapted to transfer the tractional force exerted on the traction cable by the cable stretcher along an appropriately selected direction to assure good closure of the boot.

The cable stretcher preferably comprises a lever which is manipulated to activate the cable stretcher. The lever is self-latching in the closed position. In a preferred embodiment the lever is a first lever, and the cable stretcher is double journalled such that the first lever is journalled at one of its ends onto the boot. A second lever is journalled at one of its ends onto a median portion of the first lever. The second lever includes means for attachment of the traction cable during stretching of the traction cable.

The return element preferably comprises an element adapted to be fixedly secured to the boot, and around which the traction cable is at least partially wound in a slidable manner. The return element may thus be a protuberance on the boot having a parallelepipedic shape with rounded ends, on the sides of which the cables at least partially wind in a slidable manner. The two end surfaces each serve to direct the cable directions as desired. The protuberance may be positioned above the cable stretcher and have a longitudinal axis arranged along the longitudinal median plane of the boot. Other protuberance configurations and locations are, however, clearly possible.

For example, according to another embodiment the return element is formed of one or more pulleys adapted to be pivotably mounted on the boot. The position of at least one of the pullys is variable on the boot.

The traction assembly may be mounted on the front portion, the rear spoiler, or the vamp of the upper of the boot.

Most preferably, the system is used in conjunction with a boot of the rear entry type. In this embodiment one of the two portions is a rear spoiler and the other of the portions is a front portion of the upper. As is conventional, the rear spoiler is pivotably mounted on the shell base of the boot. The front portion of the upper is a cuff which is preferably integrally formed of plastic material with a shell base. The shell base is formed of a sole, a vamp, and a heel, and the rear spoiler is pivotably mounted on the heel of the shell base at ankle level.

The traction assembly is mounted on the rear of the rear spoiler, and the system includes an upper traction cable and a lower traction cable extending across each side of the upper attached onto the front portion of the upper or cuff at two points offset in height. Rather than being directly secured to the cuff, the cables may be attached to the cuff by attachment to a stirrup mounted on the cuff.

The traction assembly is preferably, but not necessarily adapted to liberate and take up differential amounts of the upper and lower traction cables as a function of the spacing of the upper and lower traction cables to allow for release and take up of proportionate amounts of the upper and lower tractional cables during opening and closing of the portions.

The boot itself has upper and lower attachment points for attaching the upper and lower traction cables. Preferably, in the closed position the rounded upper and lower end surfaces of the return element are substantially at the level of the upper and lower attachment elements on the boot, respectively.

The upper traction cable is preferably connected to a first upper attachment point of the boot and passes over and around the upper rounded end of the protuberance. It then extends downwardly the length of one of the sides of the protuberance, before passing through two coaxial cutouts of the lever. Next, it passes up the length of the opposite side of the protuberance, and then turns around the upper rounded end of the protuberance. It is then attached onto a second upper attachment point positioned on the opposite side of the boot from the first upper attachment point.

The lower traction cable is connected to a first lower attachment point positioned on one side of the boot. It then passes over the lower end of the protuberance, before making a complete turn around the protuberance. It then passes through two coaxial cutouts of the lever, and makes a second complete turn around the protuberance, before being attached onto a second lower attachment point positioned on the opposite side of the boot of the first lower attachment point.

BRIEF DESCRIPTION OF THE DRAWINGS

The invention will now be described by way of non-limiting example with reference to the annexed drawings, in which.

DESCRIPTION OF PREFERRED EMBODIMENTS

Figure 4:
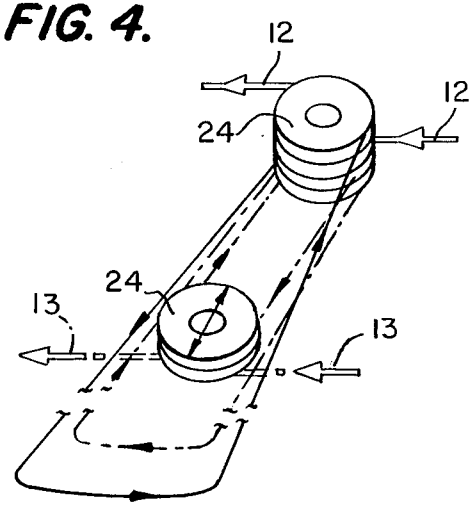
FIG. 4 is a pulley system which may be used as a return element.

The invention overcomes the disadvantages of prior art systems discussed above and provides a closure system which is usable in a majority of ski boots of the types discussed previously and in which the various tightening adjustments are pre-set, with the system assembly remaining as a single unit without any connections being necessary.

Furthermore, the system of the invention allows for the opening and closure of the boot in a single maneuver which may be performed using a gloved hand, a ski pole, the other foot, or by means of the foot or any other means of another person, the latter being particularly desirable when securing the boots of children.

More precisely, the system according to the invention utilizes at least one linkage or traction cable between the two portions of the boot to be closed. The at least one traction cable is connected, at one of its ends, to an anchorage or attachment point position which may be adjustable, by means of attachment means provided on one of the two boot portions, and, at its other end, to a traction assembly comprising a cable stretcher, and a return element mounted on the other portion of the boot. The cable stretcher is activated by a control element such as a lever which can assume at least two positions, namely, an open position in which it frees a length of the at least one cable allowing for the opening of the boot, and a self-locking closed position, in which the cable, subjected to traction, maintains the boot closed.

The return element is itself adapted to relay the tractional force exerted on the cable by the stretcher along an appropriately selected direction so as to assure a proper closure of the boot. Of course, the number of cables utilized by the system according to the invention depends upon the structure of the boot and on the quality and extent of closure which is desired.

According to a preferred embodiment of the invention, the cable stretcher comprises a journalled double lever forming a self-locking elbow (an overcentered toggle) in the closed position. The elbow comprises a control element constituted by a first lever which is journalled at one of its ends on the boot, and a second lever journalled at one of its end on the median portion of the first lever, the second lever comprising at least one attachment means for the traction cable.

Furthermore, the return element can comprise a fixed element, for example of the type used on a larger scale on the sides of nautical vessels through which ropes are passed, and around which they are wound ("chaumard" in french). The traction cable is at least partially wound around the return element and slides over it as traction is applied to the cable. Alternatively, the return element may comprise one or more pulley elements, preferably having a groove over the periphery of the pulley. The pulley is pivotably mounted around an axis at a position which may be adjustable, on the boot. Although repeated reference is made to the return element in the singular, this has been done for convenience only. Thus, the element may be formed of a plurality of elements or of a single element, provided that sufficient surfaces are provided to direct the cable(s) as desired.

It should be noted that the above traction assembly can be mounted at any location on the boot, on the condition however that its position is not incompatible with the use of the boot and that it does not pose a safety problem. The traction assembly can, for example, be mounted on the front portion, or the rear portion of the upper or the boot. According to yet another embodiment it can likewise be positioned on the top of the vamp.

According to one particularly advantageous embodiment the integrated closure system according to the invention is mounted on a ski boot of the "rear spoiler" type. In this case, the traction assembly is mounted on the rear of the rear spoiler. This assembly comprises at each side of the upper at least two traction cables, i.e., an upper traction cable and a lower traction cable, which hook onto the front portion of the upper at two points (upper and lower attachment points) which are offset in height, and are attached either directly or by means of a stirrup. By virtue of the type of the angular opening which occurs in this type of boot, the traction assembly is adapted to free, in the open position, a greater length of upper cable than lower cable.

Figure 1:
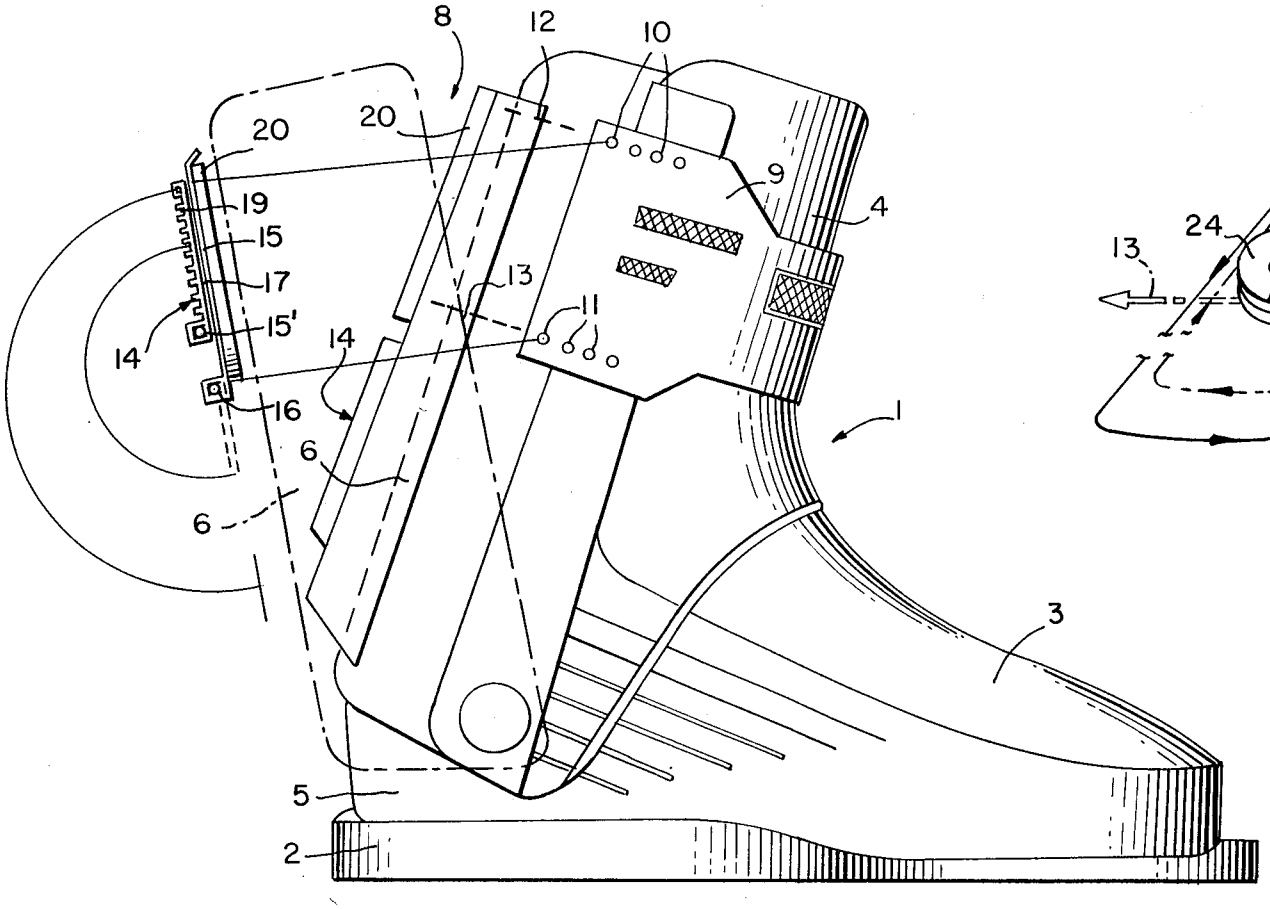
FIG. 1 is a side elevational view of a ski boot having a rear spoiler structure using the integrated closure system according to the invention.

Referring to the drawings, FIG. 1 illustrates a ski boot made of two portions, in two positions. The boot comprises a front portion 1 made of molded plastic material which includes sole 2, upper 3, upper front portion 4, the heel of shell base 5 which securely centers the heel, and a rear mobile portion or rear spoiler 6 which forms the rear portion of the upper, and which is journalled on the heel of shell base 5, substantially at the level of the ankle.

In this type of boot, opening and closing occurs by pivoting of the spoiler 6 around its journal point.

In the closed position, spoiler 6, which has a substantially cylindrical shape, partially engages within the front portion 4 of the upper of the ski boot. In the open position of the boot, spoiler 6 is pivoted back, thus forming a wide opening 8, having a V shape, through which a foot may be easily inserted.

The closure system of this boot is formed by a stirrup or strap 9 which surrounds the front portion of the upper. The ends of two traction cables are attached, in an adjustable manner, to the front of the upper, if desired, and are anchored through holes 10 and 11. Thus, an upper cable 12 and a lower cable 13 are provided on each side of the boot. Traction cables 12 and 13 are furthermore connected to a traction assembly 14 mounted on the rear portion of spoiler 6. The traction assembly comprises an elbow stretcher and a return element for the traction cables.

The elbow cable stretcher itself comprises a first lever 15, pivotably journalled at one of its ends around an axis 16 integral with spoiler 6. Lever 15 is adapted to control the opening and closure of the boot.

The stretcher further comprises a second lever 17 having a substantially U-shaped cross section, whose lateral uprights 18 are provided with a plurality of hooked cutouts 19 having a general "reverse 's'" configuration. The cutouts or notches allow for the attachment of traction cables 12 and 13. Second lever 17 is journalled at axis 15' on the median portion of lever 15.

Figure 2:
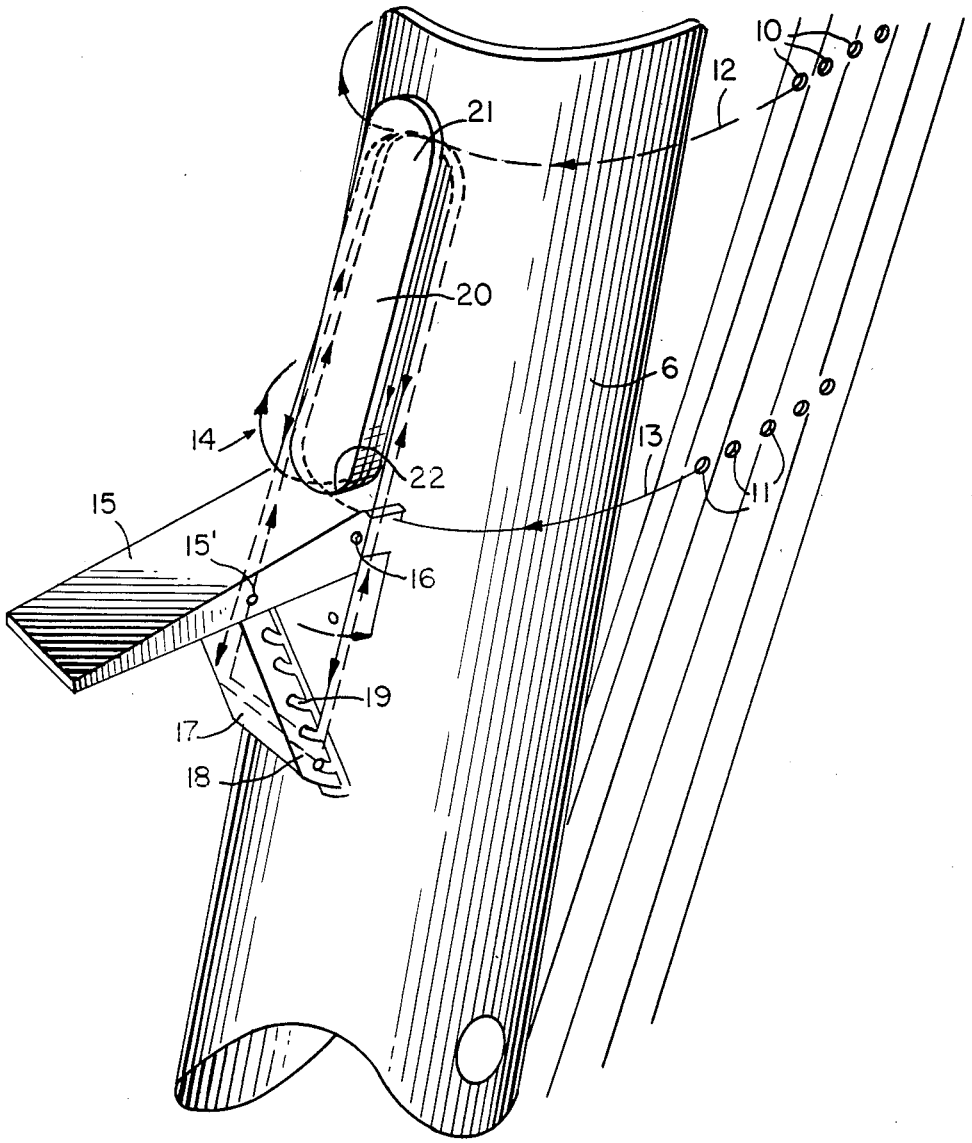
FIG. 2 is a partial perspective view of the "spoiler", this view illustrating the mechanical concept of the traction assembly utilized.

As seen in FIG. 2, the return element itself comprises a protuberance 20 having a generally parallelpipedic shape with rounded end corner surfaces 21 and 22. Traction cables 12 and 13 are slidably wound around the protuberance. Protuberance 20 is positioned and extends above the elbow stretcher and is oriented with its median longitudinal axis along the median longitudinal plane of symmetry of the boot (perpendicular to axes 15' and 16 of levers 17 and 15, respectively).

The position and dimensions of the protuberance are such that in the closed position of the boot its rounded upper and lower end surfaces 20 and 21 are substantially at the level of the upper and lower attachment holes 10 and 11, respectively, of stirrup 9.

Figure 3:
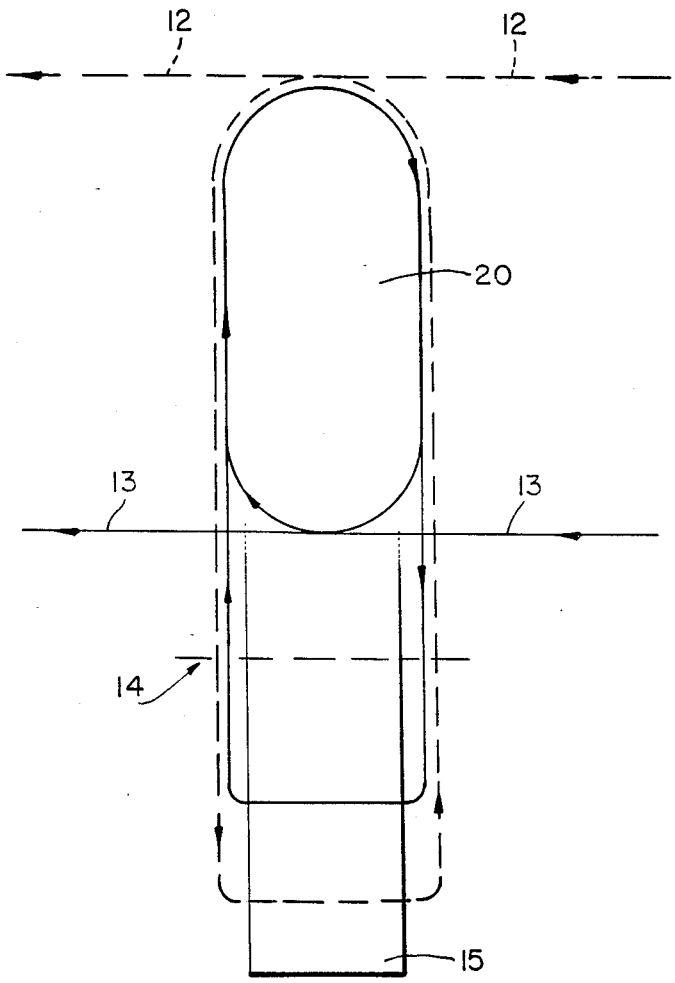
FIG. 3 is a schematic diagram illustrating the path of the traction cables of the traction assembly shown in FIG. 2.

The arrows of FIGS. 2 and 3 illustrate the path of traction cables 12 and 13. Cable 12, connected to first upper attachment hole 10 situated to one side of strap 9, passes over upper end 21 of protuberance 20 and then extends downwardly the length of one of the sides of the protuberance. The cable then passes through two coaxial cutouts 19 of lever 17, then goes up the length of the opposite side of protuberance 20, turns over the rounded end surface 21 and then is attached in a second upper attachment hole 10 of strap 9 situated on the opposite side of the shoe (not shown).

Cable 13 connected to first lower attachment hole 11 on the bottom of stirrup 9 passes around the lower end surface 22 of protuberance 20, makes a complete turn around the protuberance, and passes through two coaxial cutouts of lever 17. The cable then makes a second complete turn around protuberance 20 and is secured in a second lower attachment hole 11 of strap 9 positioned on the opposite side of the boot (not shown).

In the example shown in FIG. 2, the closure system is shown in an intermediate position, as for example in the course of opening or closing of the boot.

From this position, control lever 15 is bent downwardly to close the boot. At the end of the extent of lever 15, the two levers 15 and 17 are pressed together against spoiler 6. In the course of this movement, lever 17 exerts a traction on the cables which slide around protuberance 20 and close spoiler 6 against the front half-shell upper cuff 4 of the boot.

At the end of the extent of lever 15, under the effect of the tractional forces of cables 12 and 13, and by virtue of the offset between the attachment points of cables 12 and 13 on lever 17 and the axis of rotation 16 of lever 15, a self-locking of the stretcher by the elbow effect occurs. The boot is thus latched in the closed position.

To open the boot, it suffices,. beginning from the closed position, to pull up lever 15 upwardly approximately 180°. During the first phase of this movement, lever 17, drawn by cables 12 and 13, pivots independently of lever 15. This results in a first release of cables 12 and 13 which is illustrated in the intermediate position of FIG. 2. This intermediate position serves to allow the skier to walk with the boot on.

During the next phase of movement of lever 17, which is itself blocked from further rotation by a shoulder stop, lever 17 pivots together with lever 15, following along the direction of release of cables 12 and 13.

In the course of the third phase of its movement shown in FIG. 1), lever 17 still drawn by cables 12 and 13 pivots upwardly to abut directly against lever 15. At the end of its extent, the assembly constituted by levers 15 and 17 is bent towards protuberance 20.

As was noted previously, when opening spoiler 6, the length of cable released must differ as between the upper and lower cables 12 and 13, attached in upper attachment holes 10 or in lower attachment holes 11 of stirrup 9; the length of cable released for upper cable 12 necessarily being greater than the length of cable released for lower cable 13.

This can be achieved by adjusting the anchorage of traction cables 12 and 13 on lever 17, and by virtue of the fact that axis 16 of lever 15 is positioned substantially tangent to lower rounded end 22 of protuberance 20.

FIG. 4 illustrates a system in which the return element is in the form of two pulleys 24 around which the upper and lower cables are wound. In this embodiment the pulleys rotate upon opening and closure of the boot. If desired, lower pulley 24 may be made adjustable.

Although the invention has been described with reference to particular means, materials and embodiments, it is to be understood that the invention is not limited to the particulars disclosed and extends to all equivalents included within the scope of the claims.

I claim:

1. An integrated closure system for a ski boot, said ski boot comprising two portions adapted to be drawn together by said closure system, said closure system comprising:

(a) at least one traction cable adapted to be connected at one of its ends to a location provided on at least one of said two portions; and (b) a traction assembly comprising a cable stretcher and a return element adapted to be mounted on one portion of the boot, said cable stretcher being activated by a control element which can assume at least two positions, namely, an open position in which it frees a length of said traction cable to allow for the opening of the boot, and a closed position in which said traction cable is subjected to a tractional force to draw said two portions towards one another, and wherein closure of said closure element occurs along the direction of closure of said portion on which said cable stretcher is mounted, said return element being adapted to transfer the tractional force exerted on the at least one traction cable by the cable stretcher along an appropriately selected direction to assure good closure of the boot.

2. The integrated closure system as defined by claim 1 wherein said system is mounted on said boot.

3. The integrated closure system as defined by claim 2 wherein said cable stretcher comprises a lever which is manipulable in the direction of closure of said portion on which said cable stretcher is mounted to activate said cable stretcher, said lever being self-latching in the closed position.

4. The integrated closure system as defined by claim 3 wherein said lever is a first lever, and wherein said cable stretcher is double journalled and comprises said first lever journalled at one of its ends onto said boot and a second lever journalled at one of its ends onto a median portion of said first lever, said second lever comprising means for attachment of said traction cable during stretching of said traction cable.

5. The integrated closure system as defined by claim 1 wherein said return element comprises an element adapted to be fixedly secured to said boot, and around which said traction cable is at least partially wound in a slidable manner.

6. The integrated closure system as defined by claim 1 wherein said return element comprises one or more pulleys adapted to be pivotably mounted on said boot.

7. The integrated closure system as defined by claim 6 wherein the position of said at least one of said pulleys is variable on said boot.

8. The integrated closure system as defined by claim 1 wherein said traction assembly is mounted on the front portion of the upper of said boot.

9. The integrated closure system as defined by claim 1 wherein said traction assembly is mounted on a rear spoiler of said ski boot.

10. The integrated closure system as defined by claim 1 wherein said traction assembly is mounted on the upper portion of the vamp of said boot.

11. The integrated closure system as defined by claim 1 wherein said boot is of the rear entry type and wherein said system is mounted on said boot, and further wherein one of said two portions is a rear spoiler and the other of said portions is a front portion of the upper, said rear spoiler being pivotably mounted on the shell base of said boot.

12. The integrated closure system as defined by claim 11 wherein said front portion of the upper is a cuff integrally formed of plastic material with a shell base, said shell base comprising a sole, a vamp, and a heel, and wherein said rear spoiler is pivotably mounted on the heel of said shell base at ankle level.

13. The integrated closure system as defined by claim 12 wherein wherein said traction assembly is mounted on the rear of said rear spoiler, and system comprising an upper traction cable and a lower traction cable extending across each side of said upper, and attached onto the cuff at two points offset in height.

14. The integrated closure system as defined by claim 13 wherein each of said cables is attached to both sides of said cuff by attachment to both sides of a stirrup mounted on said cuff.

15. The integrated closure system as defined by claim 14 wherein said return element comprises a protuberance on said boot having a parallelepipedic shape with rounded ends, on the sides of which said traction cables at least partially wind in a slidable manner; and wherein said protuberance is positioned above said cable stretcher and has a longitudinal axis arranged along the longitudinal median plane of the boot.

16. The integrated closure system as defined by claim 15 wherein said boot comprises upper and lower attachment points for attaching said upper and lower traction cables, and wherein in the closed position the rounded upper and lower ends of said return element are substantially at the level of said upper and lower attachment points on the cuff, respectively.

17. The integrated closure system as defined by claim 16 wherein said upper traction cable is connected to a first upper attachment point of the boot and passes over and around the upper rounded end of said protuberance, then extends downwardly the length of one of the sides of said protuberance, and then passes through two coaxial cutouts of said lever, then passes up the length of the opposite side of the protuberance, then turns around the upper rounded end of said protuberance, and is then attached onto a second upper attachment point positioned on the opposite side of said boot from said first upper attachment point.

18. The integrated closure system as defined by claim 17 wherein said lower traction cable is connected to a first lower attachment point positioned on one side of the boot, then passes over the lower end of said protuberance, then makes a complete turn around said protuberance, then passes through two coaxial cutouts of said lever, then makes a second complete turn around said protuberance, and is then attached onto a second lower attachment point positioned on the opposite side of the boot of said first lower attachment point, said upper and lower traction cables passing through said lever at different levels whereby closure of said lever results in said upper traction cable being effectively shortened by more than said lower traction cable.

19. The integrated closure system as defined by claim 1 wherein said control element is a three position element and comprises an intermediate position adapted to release said cable sufficiently to facilitate walking.

20. The integrated closure system as defined by claim 11 wherein said front portion of the upper is a cuff formed of plastic material and is associated with a shell base, said shell base comprising a sole, a vamp, and a heel, and wherein said rear spoiler is pivotably mounted on the heel of said shell base at the ankle level.

21. An integrated closure system for a ski boot, said ski boot comprising two portions adapted to be drawn together by said closure system, said closure system comprising:

(a) two traction cables, each of said cables being adapted to be connected at one of its ends to a location provided on at least one of said two portions; and (b) a traction assembly comprising a cable stretcher and at least one return element adapted to be mounted on one portion of the boot, said cable stretcher being activated by a control element comprising at least one lever pivotably mounted on said boot, each of said cables being secured to different positions on said lever spaced differently from the pivot axis of said lever, said lever being adapted to assume at least two positions, namely, an open position in which it frees a length of each of said traction cables to allow for the opening of the boot, and a closed position in which each of said traction cables is subjected to a tractional force to draw said two portions towards one another, said at least one return element being adapted to transfer the tractional force exerted on said traction cables by said cable stretcher along an appropriately selected direction to assure good closure of the boot.

22. A ski boot comprising an integrated closure system, said ski boot comprising an upper having at least two portions including a cuff and a rear spoiler adapted to be drawn together by said closure system, said closure system comprising:

(a) an upper traction cable and a lower traction cable, each of said cables extending across each side of said upper and being secured onto the cuff at two points offset in height; and (b) a traction assembly mounted on the rear of said rear spoiler, said traction assembly comprising a cable stretcher and a return element mounted on one of said cuff or said rear spoiler, said cable stretcher being activated by a control element adapted to assume at least two positions, namely, an open position in which it frees a length of said traction cables to allow for the opening of the boot, and a closed position in which said traction cables are subjected to a tractional force to draw each of said cables together by different amounts and thereby draw said two portions towards one another, said return element being adapted to transfer the tractional force exerted on at least one of the traction cables by the cable stretcher along an appropriately selected direction to assure good closure of the boot.

23. The ski boot as defined by claim 22 wherein said return element is mounted on said rear spoiler.

24. The integrated closure system as defined by claim 23 wherein said return element provides two guides upon which each of said cables change direction at the level of their attachment to said cuff.

25. A ski boot comprising an integrated closure system, said ski boot comprising an upper having at least two portions including a cuff and a rear spoiler adapted to be drawn together by said closure system, said closure system comprising:

(a) an upper traction cable and a lower traction cable, each of said cables extending across each side of said upper and being secured onto the cuff at two points by a stirrup mounted on said cuff, said two points being offset in height; and (b) a traction assembly mounted on the rear of said rear spoiler, said traction assembly comprising a cable stretcher and a return element mounted on one of said cuff or said rear spoiler, said cable stretcher being activated by a control element adapted to assume at least two positions, namely, an open position in which it frees different lengths of said traction cables to allow for the opening of the boot, and a closed position in which said traction cables are subjected to a tractional force to draw said two portions towards one another, said return element being adapted to transfer the tractional force exerted on the two traction cables by the cable stretcher along an appropriately selected direction to assure good closure of the boot.

26. A ski boot comprising an integrated closure system, said ski boot comprising an upper having at least two portions including a cuff and a rear spoiler adapted to be drawn together by said closure system, said closure system comprising:

(a) at least one traction cable adapted to be connected at one of its ends to a location provided on at least one of said cuff and said rear spoiler; and (b) a traction assembly comprising a cable stretcher and a return element fixedly mounted on said rear spoiler around which said at least one traction cable is at least partially wound in a slidable manner, said cable stretcher being activated by a control element which can assume at least two positions, namely, an open position in which it frees a length of said traction cable to allow for the opening of the boot, and a closed position in which said traction cable is subjected to a tractional force to draw said two portions towards one another, said return element being adapted to transfer the tractional force exerted on the at least one traction cable by the cable stretcher along an appropriately selected direction to assure closure of the boot by pressure exerted on said control element only.

27. A ski boot comprising an integrated closure system for a ski boot, said ski boot comprising an upper formed of a cuff and a rear spoiler adapted to be drawn together by said closure system, said closure system comprising:

(a) two traction cables, each of said cables being attached at each of its ends to said cuff; and (b) a traction assembly comprising a cable stretcher and two return surfaces mounted on said rear spoiler portion of the boot, one return surface at the level of connection of each of said cables to said cuff, said cable stretcher being activated by a control element which can assume at least two positions, namely, an open position in which it frees a length of said traction cable to allow for the opening of the boot, and a closed position in which said traction cable is subjected to a tractional force to draw said two portions towards one another, each of said two return surfaces being adapted to direct the tractional force exerted on one of said at least one traction cables by the cable stretcher along an appropriately selected direction to assure good closure of the boot.

* * * * *